US010472895B2

(12) United States Patent
Powell et al.

(10) Patent No.: US 10,472,895 B2
(45) Date of Patent: Nov. 12, 2019

(54) VIBRATORY APPARATUS FOR DRILLING APPARATUS

(71) Applicant: FLEXIDRILL LIMITED, Auckland (NZ)

(72) Inventors: Peter Evan Powell, Timaru (NZ); Mark Christopher Cunliffe, Timaru (NZ)

(73) Assignee: FLEXIDRILL LIMITED, Auckland (NZ)

( * ) Notice: Subject to any disclaimer, the term of this patent is extended or adjusted under 35 U.S.C. 154(b) by 55 days.

(21) Appl. No.: 15/645,806

(22) Filed: Jul. 10, 2017

(65) Prior Publication Data

US 2018/0010391 A1 Jan. 11, 2018

(30) Foreign Application Priority Data

Jul. 8, 2016 (NZ) ..... 721997

(51) Int. Cl.
*E21B 7/24* (2006.01)
*E21B 25/00* (2006.01)
*E21B 10/48* (2006.01)

(52) U.S. Cl.
CPC ..... *E21B 7/24* (2013.01); *E21B 25/00* (2013.01); *E21B 10/48* (2013.01)

(58) Field of Classification Search
CPC ..... E21B 4/12; B25D 11/064
USPC ..... 175/105
See application file for complete search history.

(56) References Cited

U.S. PATENT DOCUMENTS 1,047,625 A * 12/1912 French ..... B25D 11/064 173/117
2,970,660 A * 2/1961 Bodine, Jr. ..... E21B 7/24 173/49
3,190,278 A * 6/1965 Schluchter ..... B23B 41/00 125/30.01
3,232,363 A * 2/1966 Moore ..... E21B 4/12 175/105
2005/0194187 A1* 9/2005 Gleitman ..... E21B 4/04 175/57
2010/0044046 A1* 2/2010 West ..... E21B 36/00 166/302
2010/0212967 A1* 8/2010 Powell ..... E21B 28/00 175/106
2013/0168080 A1* 7/2013 Powell ..... E21B 4/02 166/177.6
2017/0051560 A1* 2/2017 Slaughter, Jr. ..... E21B 4/02

* cited by examiner

*Primary Examiner* — Shane Bomar
(74) *Attorney, Agent, or Firm* — Studebaker & Brackett PC

(57) ABSTRACT

Disclosed is a vibratory apparatus for a drilling apparatus comprising: a housing, a rotor operable to rotate relative to the housing, the rotor comprising one or more sets of magnets, a shuttle engaged to enable movement longitudinally, the shuttle comprising one or more follower magnets, each arranged relative to a corresponding set of magnets in the rotor, wherein each set of magnets comprises magnets arranged around the rotor with a lateral spread such that on rotation the corresponding follower magnet on the shuttle will move longitudinally to follow one or more rotating magnets of the set, thus oscillating the shuttle longitudinally.

12 Claims, 6 Drawing Sheets

VIBRATORY APPARATUS FOR DRILLING APPARATUS

FIELD OF THE INVENTION

The present invention relates to vibratory apparatus for a drilling apparatus to provide vibrations in the drilling apparatus during use. The invention is useful for, but not limited to, core sample drilling operations.

BACKGROUND TO THE INVENTION

During core sampling/drilling (typically for mineral exploration), a drilling apparatus with a high speed drill bit is used. During this process, the drilling apparatus rotates thin walled drill rods (forming a casing) from surface at high speed, often at greater than 1000 rpm. At the distal end of the drill rods/casing is a (usually diamond) core drill bit—which has a hollow centre. As the drill bit is rotated and pushed forward into the formation being drilled, the core sample moves into an annulus above the drill bit known as a core (catcher) barrel. Typically, a core barrel is 1.5-6 metres long.

Once the drill bit has advanced into the substrate sufficiently for the core barrel to be full, the drilling stops. From surface, a wire cable and overshot is lowered down through the drill casing until the overshot attaches to the core barrel (and associated components). The wireline is then retracted to surface pulling the core barrel and core sample in the barrel (which is retained by a snap ring or similar). The core can then be removed from the core barrel for analyses, while the drill rods and drill bit remain in the ground acting as a temporary casing for the bore.

While core sampling/drilling using diamond (or other) drill bits is the industry standard for taking rock samples, there are problems. One such problem is that the core sample will often break and block the core barrel. This means that when the wireline is raised to surface for the inner assembly (core barrel, core sample swivel, latching system etc.), it transpires that the core barrel is only partially full (at best), or in fact the rock core has wedged in such a way as to stop further advancement of the drilling system. Also, core drilling using diamond drill bits is slow and expensive, with the core being recovered often at a rate of 20 metres or less per 12 hour shift. In extremely hard formations the drilling may cease.

SUMMARY OF INVENTION

It is an object of the invention to provide a vibratory apparatus to assist with drilling operations.

Embodiments described herein relate to a vibratory apparatus that provides vibrations that assist with drilling operations. Preferably, the embodiments could be used in core sample drilling, although that is not the only application. Where embodiments are used for core sample drilling, the embodiments can overcome at least some of the problems of existing core sample drilling.

In one aspect the present invention comprises a vibratory apparatus for a drilling apparatus comprising: a housing a rotor operable to rotate relative to the housing, the rotor comprising one or more sets of magnets, a shuttle engaged to enable movement longitudinally, the shuttle comprising one or more follower magnets, each arranged relative to a corresponding set of magnets in the rotor, wherein each set of magnets comprises magnets arranged around the rotor with a lateral spread such that on rotation the corresponding follower magnet on the shuttle will move longitudinally to follow one or more rotating magnets of the set, thus oscillating the shuttle longitudinally.

Optionally the magnets are arranged at an oblique angle around at least a portion of the rotor to provide the lateral spread.

Preferably the magnets are arranged sinusoidally or near sinusoidally around the rotor to provide the lateral spread.

Preferably the follower magnets are arranged along the shuttle.

Preferably the shuttle is engaged to the housing via a spline to rotationally constrain and enable movement longitudinally of the shuttle relative to the housing and/or rotor.

Preferably the shuttle oscillates sinusoidally or near sinusoidally.

Preferably in use in a drill string the shuttle oscillates to provide sinsusoidal or near sinusoidal vibrations in the drill string.

Preferably in use in a drill string the shuttle oscillates to provide non-impact vibrations in the drill string.

Optionally in use in a drill string with a core catcher barrel the shuttle oscillates to provide non-impact vibrations in the core catcher barrel.

In another aspect the present invention comprises a drilling apparatus or drill string with a vibratory apparatus according to any preceding claim.

Preferably the vibrations reduce the WOB requirement and/or torque requirement during drilling, and/or improve drilling progress.

In another aspect the present invention comprises a vibratory apparatus for a drilling apparatus comprising: a housing a rotor operable to rotate relative to the housing, a shuttle engaged to enable movement longitudinally relative to the housing, wherein the rotor comprises one or more sets of magnets arranged with lateral spread around the rotor such that rotation of the rotor sequentially positions magnets in each set along a reference line in a longitudinally oscillating manner to coerce corresponding magnet or magnets along the reference line in a shuttle in an oscillating manner due to magnetic interactions.

In another aspect the present invention comprises a drilling apparatus comprising a drill string, a vibratory apparatus in the drill string and a drill bit, wherein the vibratory apparatus provides micro-oscillations to the drill bit such that during the drilling operation the micro-oscillations repeatedly temporarily reduce pressure between the drill bit and the bore face to improve drilling performance for a selected WOB, torque and/or drilling RPM.

Optionally the drilling apparatus comprises a core catcher barrel wherein the vibratory apparatus provides micro-oscillations to the core catcher barrel.

Optionally the vibratory apparatus is an apparatus according to any paragraph above.

Preferably the magnets are arranged such that during rotation the interaction of the one or more sets of magnets with the one or more corresponding follower magnets is a constant positive torque reaction that reduces the cogging effect between the interacting magnets.

BRIEF DESCRIPTION OF DRAWINGS

Embodiments of the invention will be described with reference to the following drawings, of which.

DETAILED DESCRIPTION OF PREFERRED EMBODIMENTS

Embodiments of a vibratory apparatus will be described. These will be described in the context of core sample drilling, although it will be appreciated that the vibratory apparatus could be used in other drilling apparatus for use in other drilling applications.

The embodiments can provide vibrations that assist with drilling performance and/or core capture. It should be noted that embodiments shown are exemplary and that the rotor and shuttle can be interchanged.

Figure 1:
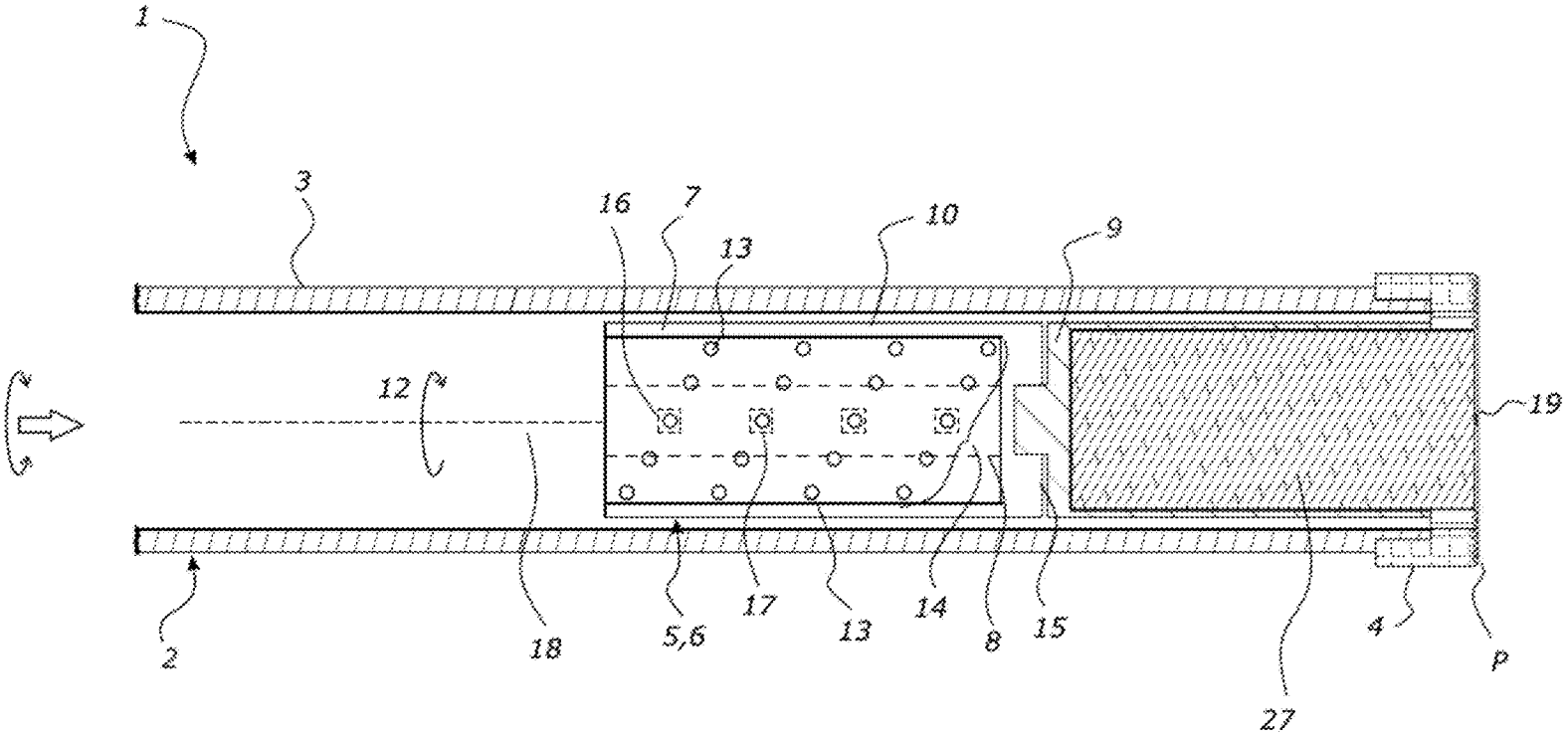
FIG. 1 shows in diagrammatic form a drilling apparatus with a drill bit, optional core catcher barrel, and a magnetic oscillator vibratory apparatus in general form.

FIG. 1 shows in diagrammatic form a portion of a core sample drilling apparatus 1 comprising a vibratory apparatus 5 in the form of a magnetic oscillator 6 according to embodiments described herein. During core sample drilling ("core drilling"), the magnetic oscillator is operated to create/provide vibrations (also termed "micro-pulses" or "micro-oscillations"), that are directly or indirectly provided, in or to the drill housing 3 and/or drill bit 4 and/or the core catching barrel 9, and more generally the drill string 2 and drilling apparatus 1. These vibrations could, for example, be sinusoidal or near sinusoidal oscillations, although other types of vibrations are possible. From here on, predominantly there will be a reference to a sinusoidal or near sinusoidal oscillations as a preferred alternative, but it will be appreciated that this is not essential and the embodiments described could be adapted to other types of non-sinusoidal vibrations.

The drilling apparatus 1 comprises a drill string 2, a drill casing (also termed drill housing) 3 comprising a plurality of drill rods coupled together. A drill bit 4 is coupled to the end of the drill housing 3, which is rotated by the drill housing to effect the drilling operation. Preferably, but not essentially, the drill bit 4 is a diamond impregnated drill bit, such as will be described later in further detail with reference to FIGS. 6A and 6B. The drill string 2 comprises a vibratory apparatus 5 in the form of magnetic oscillator 6. The vibratory apparatus can be incorporated into the drill string 2 in a suitable manner, for example by incorporation into the drill housing 3. The magnetic oscillator comprises a rotor 7 and a shuttle 8 (also termed "oscillator"), according to the embodiments to be described. Upon provision of an input rotation 12, the vibratory apparatus 5 oscillates the shuttle 8 to provide vibrations to the drill string 2 for the purposes described herein. Depending on the application, the drill string 2 might also comprise a core catcher barrel 9 between the vibratory apparatus 5 and the drill bit 4 for the purposes of taking a core sample 27. Various up hole components of the drilling apparatus 1 connected to the drill string 1 will also be known to those skilled in the art are also provided, and need not be described in detail here.

The vibratory apparatus 5 could be provided in any suitable drilling apparatus 1 for any suitable application where providing vibrations to the drilling apparatus 1 is beneficial for the reasons described above. Herein, the vibratory apparatus is described with reference to core drilling, and while this is a preferred use for the vibratory apparatus, it is not the only application. For example, the vibratory apparatus 5 could be used in any one or more of the following applications:

Tractoring including but not limited to items such as a drill string and/or tools into a bore.

Core sampling.

Drilling.

Used in wire line applications for monitoring apparatus.

The output RPM for such a magnetic oscillator can be manipulated by the input speed depending on the application for which the oscillator is being utilised for and such input speeds being within bounds of the magnetic arrays themselves. It is anticipated the RPM operating range for the oscillator, could for example, be about 1,000 to about 4,000 RPM.

Figure 1A:
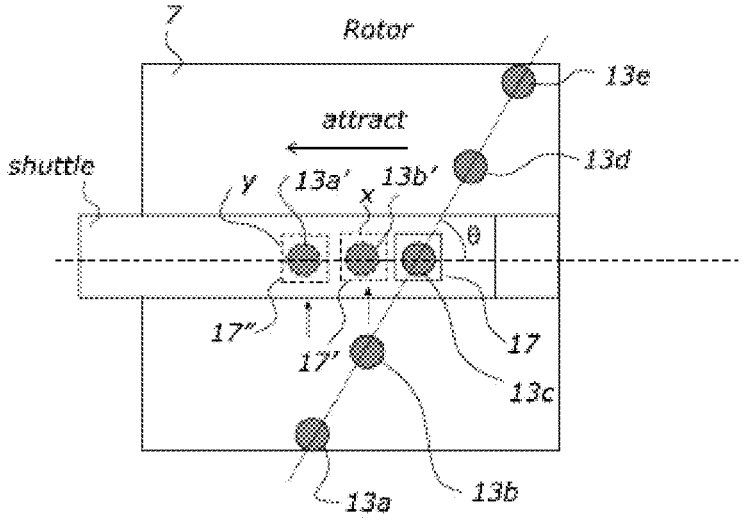
FIG. 1A, 1B shows in more detail a rotor and shuttle of the magnetic oscillator.
Figure 1B:
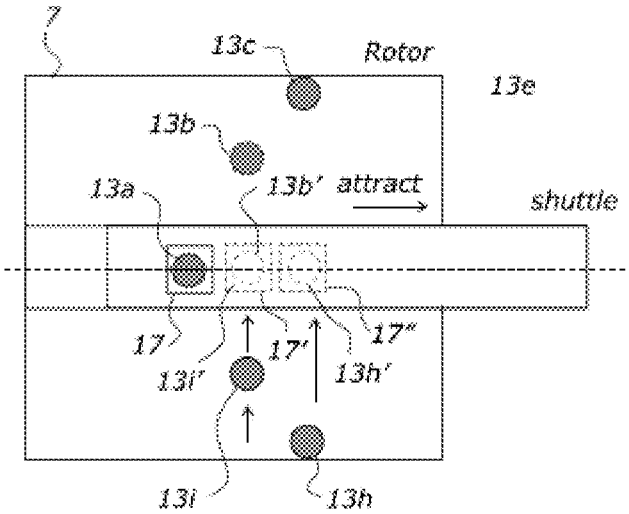

The general form of the magnetic oscillator 6 vibratory apparatus will be described in further detail with reference to FIG. 1, and the more detailed FIGS. 1A, 1B. The magnetic oscillator 6 vibratory apparatus comprises a housing 10. Inside the housing there is a rotor 7 that can rotate within/relative to the housing 10. The rotor 7 is coupled to and rotated by an external rotation source/rotary input 12, such as a turbine, PDM, or any other equivalent mechanical, electrical, hydraulic or other rotary input apparatus. The rotor 7 has a structure for supporting magnets. For example, the rotor preferably has some type of cylindrical surface, or otherwise has a circular cross-section or similar that provides a surface/substrate for magnets around a circumference. The magnet support structure has arrangement of one or more sets of magnets 13, providing a magnetic array 14. Preferably, there are a plurality of sets of magnets in the array, but this is not essential and there could simply be one set of magnets 13 (such as shown in the FIG. 4 example). A single magnet set 13 is shown in FIG. 1A, 1B for clarity, but in FIG. 1 a plurality of magnet sets 13 is shown. Each set of magnets ("magnet set") 13 is arranged around the circumference of the magnet support structure/rotor 7, such that there is a lateral/longitudinal spread of magnets in the set across a lateral/longitudinal portion of the magnet support structure 7. The magnets can be embedded or disposed in, on, or through the magnet support structure in any manner that allows magnetic interaction with the corresponding magnets and the shuttle to be described herein.

As shown in FIG. 1A, the magnets (13*a*-13*e* are visible, but more are around the back of the rotor) in the set 13 are arranged in a single cycle sinusoidal or near sinusoidal manner. As shown in FIG. 1, 1A, when viewed from one side, the magnets are arranged at an apparent oblique angle θ, which can be anywhere between 0° to 90° as appropriate. It should be noted that while the magnets in FIGS. 1, 1A appear at an oblique angle, this is only an approximation and is used for explanatory purposes. As they are arranged in a sinusoidal manner, the magnets are not arranged in a true straight-line, but it is a visual approximation. Also it should be noted that when viewed from other angles (e.g. FIG. 1B), the magnets will not appear in an oblique angle straight-line, but rather will appear in another form that is more sinusoidal in nature. As such, they are arranged at an oblique angle around a portion of the rotor. Also, more generally, other arrangements are possible—such as more generally multiple cycle sinusoidal arrangements and also non-sinusoidal arrangements to be described later. The remaining general form will be described with respect to an oblique arrangement without loss of generality—in general, it is a lateral spread of magnets that is used. Where there are a plurality of magnet sets 13, these are each arranged adjacently/sequentially and longitudinally at the oblique angle along the length of the rotor magnet support structure 7 at a suitable spacing. Each magnet set 13 comprises a plurality of identical pole magnets 13*a*-13*e*, such as a sequence of North Pole "N" or a sequence of South Pole "S" magnets. However, each magnet set 13 comprises magnet poles that are opposite to the adjacent magnet sets 13, creating a sequence of magnetic sets with alternating poles N/S along the length of the rotor 7.

The shuttle 8 extends through the rotor 7 and is engaged to prevent rotation with the rotor 7 (rotationally constrained), but allows longitudinal movement within/relative to the rotor 7 and/or housing 10. For example with reference to FIG. 2A, the shuttle 8 can be splined 15 to the housing 10 to rotationally lock the shuttle 8 to the housing 10 to prevent rotation, but allow longitudinal movement within the housing. The shuttle 8 also has a magnet support structure for supporting magnets. For example, the shuttle 8 preferably has some type of cylindrical surface, or otherwise has a circular cross-section or similar that provides a surface for magnets around a circumference. Along the longitudinal length of the shuttle magnet support 8 there is a shuttle array 16 of one or more shuttle magnets 17 arranged along a nominal reference line/longitudinal datum 18. The magnets can be embedded or disposed in, on, or through the support structure in any manner that allows magnetic interaction with the corresponding magnets on the rotor to be described herein. The shuttle array 16 comprises a sequence of alternating north/south pole N/S magnets. Each shuttle magnet 17 has a corresponding (e.g. oblique) magnet set 13 on the rotor, which is more clearly seen in FIG. 1A. The shuttle 8 is arranged relative to the rotor 7 such that each shuttle magnet 17 is arranged so it (due to magnetic interactions) is longitudinally aligned with a magnet 13*a*-13*e* in the corresponding magnet set 13 on the rotor. Each shuttle magnet 17 has an opposite pole (e.g. South Pole "S" in FIG. 1A) to that of the poles (e.g. north poles "N" in FIG. 1A) of the magnets 13*a*-13*e* of the corresponding magnet set 13 on the rotor 7. For example, if the shuttle magnet 17 is a north pole, then the corresponding magnet set 13 will have South Pole magnets 13*a*-13*e*. If the shuttle magnet 17 is a south pole, then the corresponding magnets set 13 will have North Pole magnets 13*a* to 13*e*.

As the rotor 7 rotates, the shuttle magnet 17 will be magnetically attracted (magnetic interaction) sequentially to the magnets 13*a* to 13*e* in the corresponding magnet set 13 on the rotor 7. Due to the magnetic attraction, as the rotor 7 rotates, each shuttle magnet 17 will follow/track each magnet 13*a* to 13*e* in the corresponding magnet set 13 as each magnet 13*a* to 13*e* of the corresponding magnet set 13 sequentially rotates past the shuttle magnet array 16 along the reference line 18. Due to the longitudinal spread of magnets 13*a* to 13*e* (due to the oblique angle/sinusoidal arrangement of the magnet set), each sequential magnet 13*a* to 13*e* as it rotates will pass the reference line 18 at a different longitudinal point along the rotor 7. This will pull/drag/attract the corresponding shuttle magnet 17 towards the magnet 13*a* to 13*e*, thus causing longitudinal movement of the shuttle 8. Due to the longitudinal spread of magnets/each magnet set, the longitudinal position of the current magnet 13*a* to 13*e* as it passes the reference line 18 will in effect oscillate back and forth, thus causing an oscillation of the corresponding shuttle array 16 (and thus shuttle 8 itself) as it follows each sequential magnet as it rotates past the reference line 18.

For example, referring to FIG. 1A, the shuttle magnet 17 lines up with rotor magnet 13*c*. As the rotor 7 rotates, the magnet 13*b* moves into position X (see dotted magnet 13*b*') along the reference line 18 and will attract the shuttle magnet across (see dotted magnet 17'). Then, next magnet 13*a* will move into position Y (see dotted magnet 13*a*'), and attract the shuttle magnet 17 further across (see dotted magnet 17"). This continues for all magnets 13*a*-13*e* as the rotor rotates. Eventually, this will result in the position shown in FIG. 1B, at which point the shuttle will start moving in the opposite direction as other magnets 13*i*, 13*h* (originally at the back of the rotor) start rotating past the reference line 18 and attracting the magnet 17 (see dotted magnets 17'''', 17'''').

An advantage of the magnets arrayed in this manner is that during rotation a constant positive torque reaction is experienced thus reducing the cogging effect between the magnets on the rotor and shuttle. This reduces and/or minimises magnetic torque variations on the rotational apparatus and other up-hole equipment, including in particular PDMs, and downhole tools.

In the case of a plurality of magnets sets 13, with a plurality of corresponding shuttle magnets 17 on the shuttle, each magnet set/corresponding shuttle magnet will interact in the same way, increasing the force provided by the oscillating shuttle. The frequency of the vibrations can be controlled by controlling the rotation speed of the rotor 7, and the magnitude of the vibrations can be controlled by altering the longitudinal spread of magnets 13*a* to 13*e* along the rotor. For example, a steeper angle of oblique magnets will create a longer amplitude of shuttle movement. The input speed and/or shuttle mass can also be altered to affect operational frequencies and output force.

As such, simple rotation of the rotor will allow for controlled oscillations for vibrating the drilling apparatus. The oscillations travel from the vibration apparatus 5 through the drill housing 3 and down to the drill bit 4. The vibrations also travel from the housing of the vibration apparatus 5 through to the core catcher barrel 9.

Referring to FIG. 1, the vibrations assist with a drilling process, such as a core drilling process. In typical core drilling processes, weight-on-bit (WOB) is provided downwards so that the drill bit 4 abuts and presses against the bore face 19 under pressure, and the drill string 2 is rotated to rotate the drill bit 4. This rotation and pressure on the drill bit 4 excavates a cut ring in the shape of the bit at the bore face 19. The cuttings are flushed away by the drilling mud 100 that flows down hole and out through the bit, and then back up hole. This leaves a central core that moves into the core barrel 9 as a core sample 27.

However, there are many deficiencies in a typical core drilling process. For example, core drilling can make slow progress. Progress can be increased by increasing the WOB. But, increasing WOB increases the pressure P of the drill bit 4 on the bore face 19 and therefore increases the torque T required to rotate the drill bit at a desired RPM. This requires additional rotational input energy 12 and also can increase wear on the drill bit 4 and may in some instances lead to rotational sticking and crooked holes. Also, higher WOB can lead to a fractured core and/or difficulty in retrieving the core 27. In this case, the entire drill string may need to be retracted to retrieve the core. In existing core drilling, sometimes hammering can be used to assist with core drilling progress through the substrate. However, hammering provides impulses or impacts which are vigorous in nature. This can affect the integrity of the core 27 and/or damage/wear the drill bit 4, particularly when the drill bits are diamond impregnated bits.

The vibrational apparatus 5 as described herein helps obviate some of these problems by generating vibrations that assist the core drilling process. Referring to FIG. 1, the vibrations are or cause micro-pulses (micro-oscillations) in the drill string 2. These micro-pulses can allow the following to occur:

The micro-pulses repeatedly create both a positive and negative pressure pulse. The downward oscillation movement of the shuttle applies a downward pressure pulse indirectly to the drill bit, this provides the following advantages.

- It assists with keeping the (preferably) diamond impregnated bit sharp and avoids bit polishing.
- It allows for rapid/efficient drilling of the formation With each upward oscillation movement of the shuttle there is a corresponding indirect pressure release between the drill bit and rock face which provides additional advantages.

- It assists with efficient removal of rock cuttings from between the drill bit and the rock face.
- It assists with the cooling of the drill bit, by allowing the drilling fluid to better flush the face of the drill bit.

The downward and upward pressure oscillations (micro-pulses) provide the following further benefits to the drilling system.

- Reduced torsional drag pressure between the drill bit and rock face.
- The reduced torque allows for long bit life and straighter bore holes.
- The micro-pulses have shown an ability to support drilling significantly faster than comparable tests without the vibratory system—even with less weight on bit—than comparable baseline testing (it is believed that the pressure pulses are extremely effective at keeping the (diamond impreg) bit in sharp condition and not allowing it to polish),
- A percentage of the vibrational energy finds its way—indirectly, to the core barrel, and has shown to be very effective at assisting with rock core migration into the core barrel allowing for "full" core runs and undamaged core samples—this is especially beneficial in fractured/split formations.

The vibration apparatus 5 as described herein provides vibrations that achieve the above. This is achieved with non-impact/micro-impulse vibrations (compared to typical hammering operations). This is achieved without the need for springs or other energy retention/return devices to promote sinusoidal or near sinusoidal oscillations and to prevent collisions. This is achieved without the need for contacting surfaces in the vibratory apparatus that may wear.

The output RPM for such a magnetic oscillator can be manipulated by the input speed depending on the application for which the oscillator is being utilised for and such input speeds being within bounds of the magnetic arrays themselves. It is anticipated the RPM operating range for the oscillator, could for example, be about 1,000 to about 4,000 RPM.

Figure 2A:
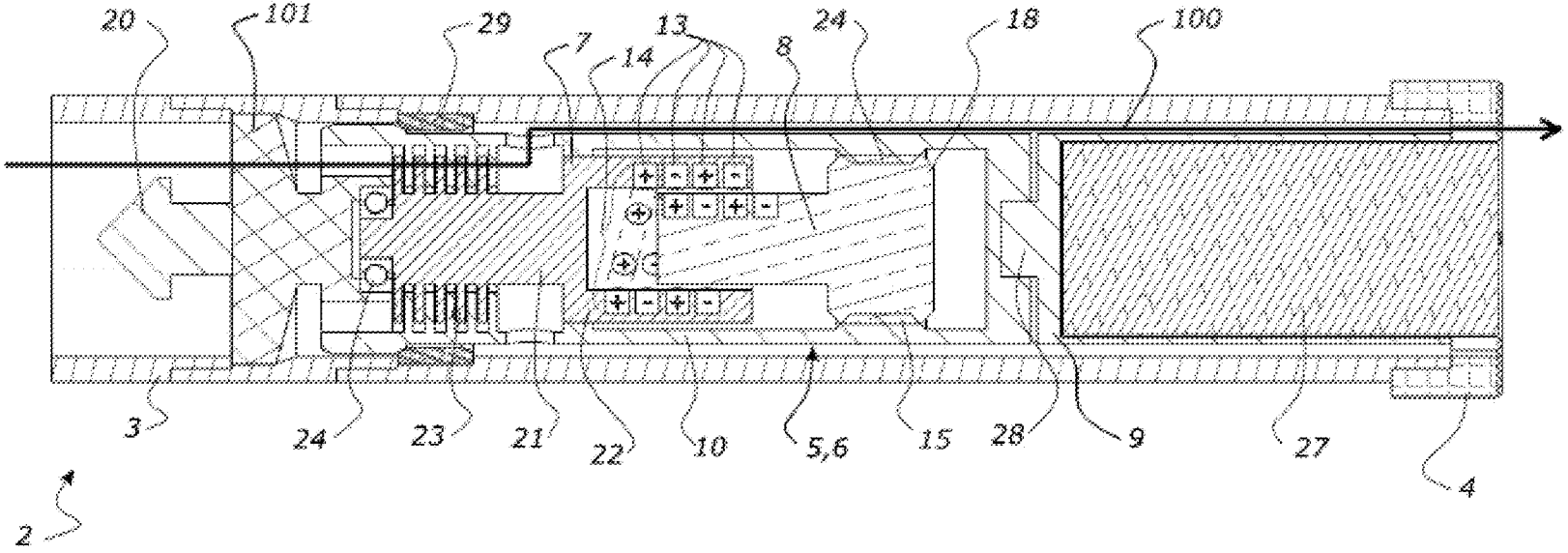
FIG. 2A, shows in diagrammatic form a magnetic oscillator according to one embodiment, in a drilling apparatus with a core barrel and drill bit.
Figure 2B:
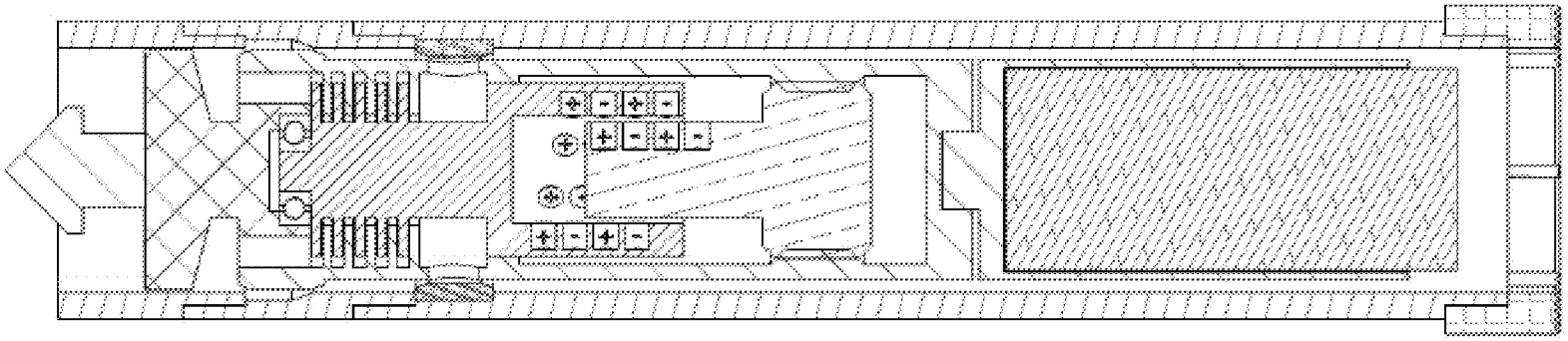
FIG. 2B shows the magnetic oscillator of FIG. 2A being withdrawn back uphole with a core captured within the core barrel.
Figure 3A:
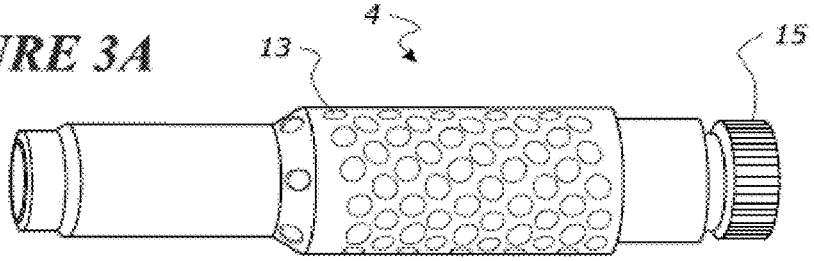
FIG. 3A shows the rotor and shuttle of a magnetic oscillator that is a variation of the embodiment shown in FIGS. 2A, 2B.
Figure 3B:
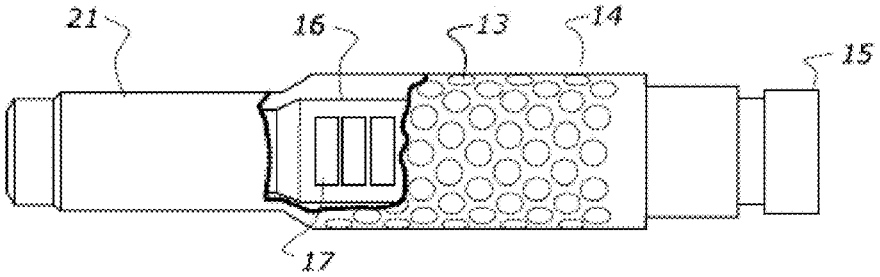
FIG. 3B shows a partial cutaway view of the rotor and shuttle of a magnetic oscillator that is a variation of the embodiment shown in FIGS. 2A, 2B.
Figure 3C:
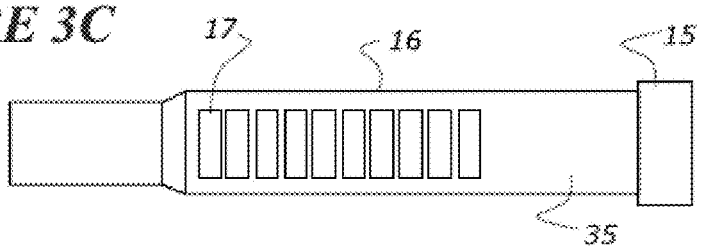
FIG. 3C shows the shuttle of a magnetic oscillator that is a variation of the embodiment shown in FIGS. 2A, 2B.
Figure 3D:
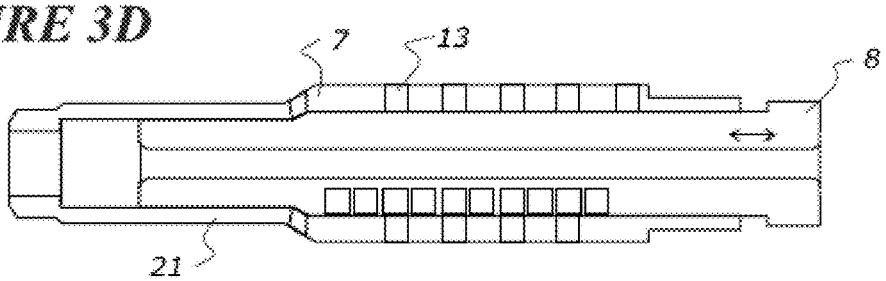
FIG. 3D shows a cross-sectional view of the rotor and shuttle of a magnetic oscillator in that is a variation of the embodiment shown FIGS. 2A, 2B.

One exemplary embodiment of a vibratory apparatus will now be described with reference to diagrammatic FIGS. 2A and 2B. FIGS. 2A, 2B shows in cross-sectional form a drilling apparatus 1 with a drill string 2 and drill housing 3, drill bit 4 (such as diamond impregnated drill bit), core sampling barrel 9 and a magnetic oscillator 6 vibratory apparatus 5. The vibratory apparatus 5 and core sampling barrel 9 can be extracted from the inside of the drill housing 3 using a wire line or similar which couples to an overshot 20 of the latch assembly 101. In FIG. 2A, the apparatus shown with the vibratory apparatus 5 and core barrel 9 in place, whereas FIG. 2B shows the vibratory apparatus 5 and core sample barrel 9 being extracted via the overshot 20.

The vibratory apparatus 5 comprises a housing 10 with a rotor 7 and a shuttle 8. The housing sits within the drill string 2 (e.g. within the drill housing 3) and couples to the core catcher barrel 9. The rotor 7 comprises a magnet support structure 22 and a drive shaft 21 extending from support structure 22 up hole. The rotary input turbine 23 (or PDM or equivalent) engages with the driveshaft 21, which provides rotary input to the rotor 7 and the vibratory apparatus 5. The end of the driveshaft 21 is supported by and rotates on bearings 24. The magnet support structure 22 is a hollow cylindrical structure with the magnet sets 13 arranged at an oblique angle on the wall of the cylinder. Each set of magnets are arranged as arrays 14 is indicated with dotted lines. Four magnet arrays sets 14 comprise individual magnets 13 (or other suitable number, four are shown by way of example only) are provided, each at an oblique angle and each set having magnetic poles (north "+" and south "−") that are opposite poles to those magnets of the adjacent sets. The shuttle 8 comprises a solid cylindrical portion with a spline 15 that engages with corresponding splines 24 extending internally from the housing 10. The solid cylindrical portion provides the magnet support structure for the shuttle magnets 16, which are arranged within the support structure in a line with alternating poles. The magnet support structure further provides a shuttle mass that can contribute to the output force of the vibratory apparatus. The turbine 23 is operated to rotate the drive shaft 21 of the rotor 7. As the rotor rotates, the magnetic interactions between the magnets 13*a* to 13*d* in the magnet sets 13 at the reference line and the shuttle magnets 17 cause the shuttle to oscillate, as previously described.

As the shuttle 8 oscillates vibrations travel/transfer into the drill housing 3. Upward vibrations travel through the latch 101 to the drill housing 3 via the abutment of the latch 101 onto a drill rod of the drill housing 3. Downward vibrations travel through from the vibratory apparatus housing 10 through a landing ring 29 into the drill housing 3. The vibrations received by the drill housing travel through to the drill bit 4. Vibrations from the shuttle also travel through the vibratory apparatus housing 10 to the core catcher barrel 9 through the coupling 28 between the vibratory apparatus housing 10 and the core catcher barrel 9. This assists with travel of the core into the core catcher barrel 9 and can prevent and/or assist with preventing a core blockage. This then potentially obviates the need to retract the whole drill string 2 from the bore hole.

FIGS. 3A-3D show design drawings of a rotor and shuttle arrangement, which is a variation to the magnetic oscillator embodiment that is shown diagrammatically in FIGS. 2A, 2B. This operates in the same way as the previous embodiment and the general embodiment. It comprises a rotor 7 with a cylindrical magnet support structure that extends into a drive shaft with a coupling for attachment to a drive source 12. Arrays of magnets 14 are located on the outside of the support structure. The magnets 13 are arranged in an oblique arrangement. The shuttle 8 comprises a support structure 35 with magnets 17 arranged in an array along the date or reference line 18. A spline 15 is provided.

The embodiments shown above are exemplary only, and other variations will be envisaged by those skilled in the art, which provide oscillating movement of a shuttle by the interaction between a follower magnet on the shuttle and a magnet set on the rotor arranged with a lateral spread.

Figure 4:
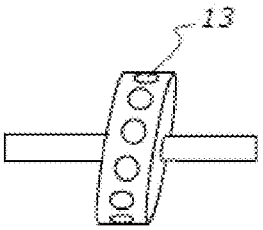
FIG. 4 shows in diagrammatic form, a single magnet set of the rotor as shown in FIG. 3A.

As shown in FIG. 4, there might simply be one magnet set. Additional magnet sets provide additional force.

Figure 5:
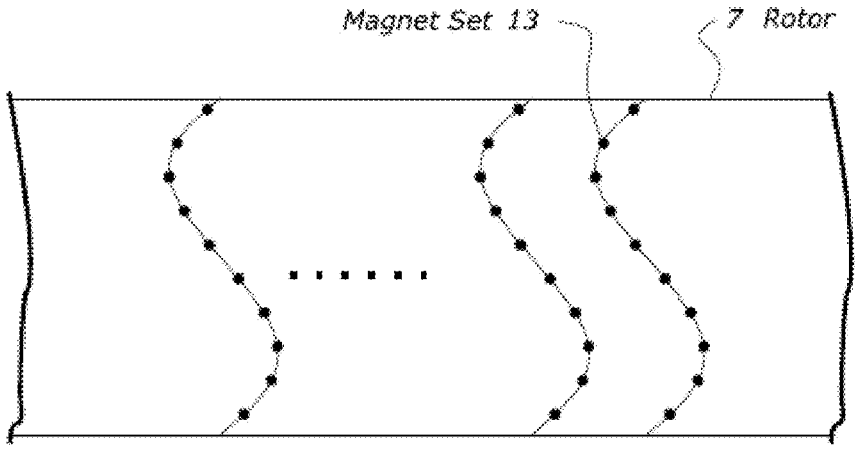
FIG. 5 shows in diagrammatic form, a rotor with a multiple cycle sinusoidal arrangement of magnets around the rotor in each magnet set.

In another embodiment shown in FIG. 5, the magnets 13*a* to 13*e* on the rotor could be laterally spread with another arrangement. For example, they could each have a sinusoidal or near sinusoidal arrangement, with one or more cycles around the rotor 7. Each cycle provides one round of oscillation, and therefore multiple cycles of sinusoid will provide multiple shuttle oscillations for each rotation of the rotor. The magnets could be arranged in a sinusoid with any suitable number of cycles around the rotor. In this manner, by arranging the magnets in a magnet set or array in a sinusoidal arrangement with a particular number of cycles enables control of the frequency of shuttle oscillations versus the frequency of rotation of the rotor. It should be noted that the first embodiment with an oblique arrangement of the magnet set is in fact a special case of sinusoid arrangement with a single cycle.

Any arrangement of a magnet set on a rotor that causes effective longitudinal movement (with laterally arranged magnets or otherwise) of the position of a magnet in the set as it passes a nominal reference line containing a corresponding magnet on the shuttle can be encompassed by the invention. For example, instead of sinusoid or arrangement of magnets, there could be another curvilinear arrangement of magnets that is non-sinusoidal. Yet in further alternatives, there may not be a curvilinear arrangement of magnets in the magnet set, but some other arrangement (such as a saw tooth arrangement). Any lateral/longitudinal arrangement of magnets or otherwise could be used. In more general terms, the rotor provides a one or more sets of magnets arranged such that upon rotation the longitudinal position of magnets in the magnet set oscillates along a reference line as the magnets are sequentially passed through the reference line due to rotation of the rotor.

In another alternative, for each magnet set 13 on the rotor 7 there could be two or more corresponding magnets on the shuttle 8. These could be for example arranged around the circumference of the shuttle 8 coincident with the magnets 13*a* to 13*e* in the corresponding magnet set 13. The arrangement and poles of the magnets in such an arrangement would be coordinated to achieve the required oscillating movement. In another alternative, the rotor 7 could sit coaxially on the inside of the shuttle 8, but with the same arrangement of magnets. As described herein, the magnetic interactions are magnetic attractions, but alternatively the magnets could be selected and arranged so that oscillations work on the basis of repulsion magnetic interactions.

Figure 6A:
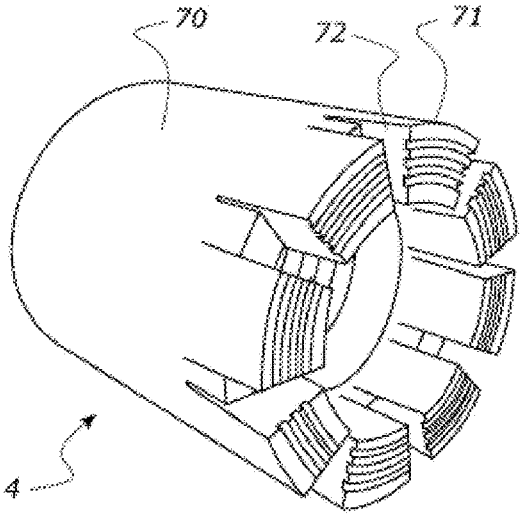
FIG. 6A shows a perspective view of the diamond impregnated bit for use in core drilling apparatus with a vibratory apparatus.
Figure 6B:
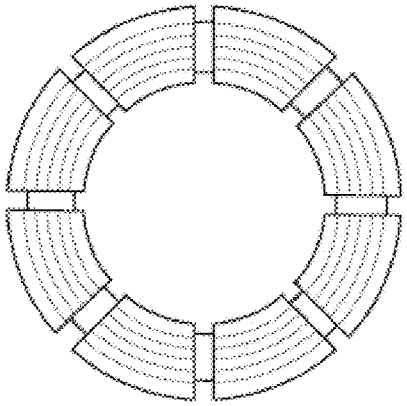
FIG. 6B shows the end view of the diamond impregnated bit of FIG. 6A.

The application of micro-pulses during the drilling operation can be particularly useful with diamond impregnated drill bits, an example of such is shown in FIGS. 6A and 6B. Although it should be noted that the benefits of micro-pulses can also be seen with other types of drill bits—for example, surface set core bits, PDC core bits, carbide core bits.

Referring to FIGS. 6A to 6B, diamond impregnated bits are made up of a body 70, with a thread and a cutting matrix 71. Junk slots 72 are also provided to allow the cuttings to move out of the way as the drilling mud is flushed downhole. The cutting matrix is a mix of various metals with often hundreds of small irregular shaped diamonds (usually synthetic) placed within the matrix. When drilling, the drill apparatus 1 rotates the drill rods from surface at high speed—water and/or drilling mud is pumped down hole from surface to cool the bit and flush away the cuttings (fine sand particles) while the solid rock core advances inside the core bit into a core catcher for periodic extraction to surface (normally via a wireline system)—while leaving the drill rods in the ground. While drilling, the small diamonds scratch/cut away the rock formation—as the diamonds themselves wear away, the metallic matrix also erodes allowing new sharp diamonds to be exposed to the cutting surface. Diamond drilling is a compromise between applying enough WOB/bit RPM to drill at an economic speed, and ensuring that the drill bit is not prematurely consumed. It is also important that the bit does not get "polished" by having insufficient WOB, if this happens the bit will stop cutting and the driller will need to work through a re sharpening exercise—which in some instances can require metal bolts or broken glass bottles to be dropped down hole to assist with bit sharpening. The vibratory apparatus 5 described herein and micro-pulses it creates assist with avoiding some of the problems faced by diamond impregnated bits. The micro-pulses generated by the vibratory apparatus work in conjunction with the diamond impregnated bits (although envisaged other suitable bits could be used) to improve ROP even with light Weight on Bit (WOB). The light WOB results in a low torque being applied to the bit without the disadvantage of polishing the bit and/or wearing the bit down leading to an overall longer bit life and straighter boreholes.

The invention claimed is:

1. A vibratory apparatus for a drilling apparatus comprising:

a housing a rotor operable to rotate relative to the housing, the rotor comprising one or more sets of magnets, a shuttle engaged to enable movement longitudinally, the shuttle comprising one or more follower magnets of a first polarity, each arranged relative to a corresponding set of magnets in the rotor of a second opposite polarity, wherein each set of magnets on the rotor comprises magnets that are arranged around the rotor and displaced longitudinally across the rotor so that the magnets are arranged in a curvilinear sequence that curves in the longitudinal direction such that on rotation the corresponding follower magnet on the shuttle will move longitudinally due to following the curvilinear longitudinal displacement across the rotor by way of magnetic attraction of one or more rotating magnets of the set of the second polarity, thus oscillating the shuttle longitudinally.

2. The vibratory apparatus according to claim 1 wherein the magnets are arranged at an oblique angle around at least a portion of the rotor to provide the lateral spread.

3. The vibratory apparatus according to claim 1 wherein the magnets are arranged sinusoidally or near sinusoidally around the rotor to provide the lateral spread.

4. The vibratory apparatus according to claim 1 wherein the follower magnets are arranged along the shuttle.

5. The vibratory apparatus according to claim 1 where the shuttle is engaged to the housing via a spline to rotationally constrain and enable movement longitudinally of the shuttle relative to the housing and/or rotor.

6. The vibratory apparatus according to claim 1 wherein the shuttle oscillates sinusoidally or near sinusoidally.

7. The vibratory apparatus according to claim 1 wherein in use in a drill string the shuttle oscillates to provide sinsusoidal or near sinusoidal vibrations in the drill string.

8. The vibratory apparatus according to claim 1 wherein in use in a drill string the shuttle oscillates to provide non-impact vibrations in the drill string.

9. The vibratory apparatus according to claim 8 wherein in use in a drill string with a core catcher barrel the shuttle oscillates to provide non-impact vibrations in the core catcher barrel.

10. The drilling apparatus or drill string with a vibratory apparatus according to claim 1.

11. The drilling apparatus or drill string according to claim 10 wherein the vibrations reduce the WOB requirement and/or torque requirement during drilling, and/or improve drilling progress.

12. A vibratory apparatus for a drilling apparatus comprising:

a housing a rotor operable to rotate relative to the housing, a shuttle engaged to enable movement longitudinally relative to the housing, wherein the rotor comprises one or more sets of magnets of a first polarity, wherein each of the magnets comprises magnets that are arranged around the rotor and displaced longitudinally across the rotor so that the magnets are arranged in a curvilinear sequence that curves in the longitudinal direction such that rotation of the rotor sequentially positions magnets in each set along a reference line in a longitudinally oscillating manner to coerce corresponding magnet or magnets of a second opposite polarity along the reference line in a shuttle in an oscillating manner due to following the curvilinear longitudinal displacement across the rotor by magnetic attraction.

* * * * *